United States Patent [19]

Maier

[11] 3,981,424

[45] Sept. 21, 1976

[54] EXPLOSIVE CHARGE DRIVEN SETTING GUN

[75] Inventor: Elmar Maier, Feldkirch-Tisis, Austria

[73] Assignee: Hilti Aktiengesellschaft, Schaan, Liechtenstein

[22] Filed: July 25, 1975

[21] Appl. No.: 599,066

[30] Foreign Application Priority Data

July 29, 1974 Germany ..... 2436446

[52] U.S. Cl. ..... 227/10

[51] Int. Cl.[2] ..... B25C 1/14

[58] Field of Search ..... 227/8, 9, 10

[56] References Cited

UNITED STATES PATENTS

| | | | |
|---|---|---|---|
| 3,554,424 | 1/1971 | Newton et al. | 227/8 |
| 3,558,032 | 1/1971 | Oefinger | 227/8 |
| 3,679,118 | 7/1972 | Maier et al. | 227/10 |

*Primary Examiner*—Granville Y. Custer, Jr.
*Attorney, Agent, or Firm*—Toren, McGeady and Stanger

[57] ABSTRACT

In an explosive charge driven setting gun a breech block is located in the rear of the gun housing and the gun barrel is axially displaceable within the gun housing. A firing projection is formed on the rear end of the barrel so that a propellant charge supported on the breech block can be fired by displacing the barrel rearwardly against the breech block. The displacement force can be provided by a spring which biases the barrel rearwardly. A latch can be mounted in the housing for securing the barrel in a forward position and when the latch is released, the barrel can be displaced rearwardly against the breech block.

24 Claims, 5 Drawing Figures

EXPLOSIVE CHARGE DRIVEN SETTING GUN

SUMMARY OF THE INVENTION

The present invention is directed to an explosive charge driven setting gun and, more particularly, to a setting gun in which the gun barrel is axially displaceable relative to the gun housing so that the barrel can be displaced rearwardly into contact with a propellant charge for firing the gun.

Setting guns with axially displaceable barrels are known. Normally such guns are made ready to be fired by pressing the gun muzzle against the receiving material so that the barrel is pushed rearwardly in the housing and forms, in combination with the breech block at the rear of the housing, a firing chamber closed on all sides. The propellent charge or cartridge located within the firing chamber is ignited by directing the firing pin, which can be cocked against the force of a spring, against the propellent charge when the barrel is pressed in a rearwardly direction. Usually, the firing pin is released by pulling on a trigger.

In another type of known guns, the spring cooperating with the firing pin is first compressed by pulling the trigger and released when the firing pin has reached a certain position. Furthermore, guns are known where the firing pin is actuated electromagnetically, that is, by the force of an electromagnet.

All of these guns require a complicated firing mechanism which is generally highly susceptible to trouble.

To avoid the problems experienced with firing mechanisms, it has been attempted to leave the firing mechanisms out of explosive charge driven setting guns. Specifically, the firing of the propellent charge has been effected in such guns by the action of the gun muzzle striking against the receiving material. When the gun muzzle contacts the receiving material, a driving piston, displaceably mounted within the gun, is driven rearwardly, usually by the fastening element to be inserted, toward the propellent charge and the charge is ignited by means of a lug located on the piston or on the breech block.

Such guns have the disadvantage, however, when the muzzle is driven against a soft receiving material, the fastening element within the muzzle starts to penetrate into the material and the piston does not receive sufficient force to fire the propellent charge. There is the further disadvantage that the length of the driving piston must be adapted to the length of the fastening elements.

For special applications, such as fastening plates to the interior of metal molds, setting guns with small outside dimensions are required. Since the number of fastenings to be made is usually quite great, the setting gun must also have a low susceptibility to operating problems.

Therefore, it is the primary object of the present invention to provide an explosive charge driven setting gun which is simple in construction, trouble-free, and incorporates a reliable firing mechanism.

In accordance with the present invention, the problems previously experienced are solved by utilizing the barrel as the member for firing the propellent charge.

In accordance with the invention, the propellent charge is located in the rear of the housing containing the barrel and the barrel is displaced rearwardly with sufficient force from a latched position into the firing position. The rear end face of the barrel strikes at least a portion of the forwardly facing surface of the propellent charge which is supported by the breech block. Advantageously, the breech block provides a support for the full rearwardly facing surface of the propellent charge. Alternatively, a disk shaped intermediate plate can be positioned between the rear end of the barrel and the breech block for transmitting the firing force from the barrel to the propellent charge. The intermediate piece can be formed as a part of the barrel. As a result, a special firing mechanism of the conventional type, which is more elaborated and more susceptible to trouble, can be eliminated affording a considerable reduction in the size of the setting gun. The propellent charge be arranged in the setting gun at any point between the rear end of the barrel and the breech block. However, it has been found to be particularly effective to locate the charge on the breech block which then serves as an abutment against which the propellent charge is supported during the firing operation.

In a specific embodiment of the invention, the rear end of the barrel is provided with a firing projection or nose which insures that the propellent charge is fired with a relatively low kinetic energy propelling the barrle. It is also possible to provide the firing projection on the breech block or to use a combination of a projection on both the barrel and the breech block. The firing nose or projection can have a cross section in the form of a circle or circular segment, depending on the type and form of the propellent charge and it may be provided with a point which contacts the propellent charge for particularly easy firing.

To achieve a high compression of the explosive gases generated when the propellent charge is fired, the rear end of the barrel is provided with an annular shoulder which fits closely over the propellent charge.

Accordingly, the cooperating action of the breech block and the rear end of the barrel assure that the propellent charge is tightly enclosed within the firing chamber so that a high degree of tamping is attained which affords a maximum driving power from the setting gun. The movement of the barrel against the breech block required for firing the propellent charge is achieved, for example, in a simple arrangement by pressing the front end of the barrel, which extends outwardly from the housing, against the receiving material. This action displaces the barrel rearwardly into contact with the breech block. This arrangement is particularly advantageous at fastening points which are difficult to reach, since the setting gun can also be operated by means of an extension rod.

In a kinematic reversal of the firing process, it is also possible to strike the rear of the housing so that the barrel strikes the breech block due to inertia. However, this embodiment is undesirable in most cases and should be avoided for safety reasons to prevent misfiring if the setting gun falls striking its rear end against a surface. To provide for the safe operation of the setting gun, another feature of the invention involves the use of axially displaceable pins in operative engagement with the barrel whose rear end extend from the rear end of the housing when the barrel is in a locked position. If the rear end of the gun should strike against a surface then the projecting pins would also strike against the same surface and prevent the barrel from moving rearwardly against the breech block.

Another safety feature of the invention is the provision of a latch which engages the barrel and prevents its displacement against the breech block. To fire the gun, the latch must first be disengaged from the barrel and when it is released the barrel then moves rearwardly to fire the propellent charge. The latch can be both rotatable and displaceable and, preferably, is spring-loaded into locking contact with the barrel. To provide the engagement of the latch barrel, the barrel is preferably provided with shoulders or a recess, for example, by milling.

To assure that the barrel is returned automatically into a position spaced forwardly from the breech block, spring means are incorporated into the housing which normally bias the barrel forwardly away from the breech block. To fire the gun, it is necessary to overcome the biasing action of such spring means. With this safety feature it is possible to prevent the barrel, if the latch happens to be disengaged, from moving rearwardly into contact with the breech block due to the light displacing force which would be sufficient to cause an accidental firing.

In a preferred embodiment the barrel is made up of two axially extending parts, a front part and a rear part. The rear part which is displaced against the propellent charge can always remain in the housing, independent of the length of the fastening elements to be inserted, while the front part of the barrel which is adapted to the particular fastening element to be used, can be an exchangeable part.

In the two-part barrel, the latch engages the rear part of the barrel.

Another feature of the invention, which is particularly suitable for accurate insertion of fastening elements, involves the use of a compression spring positioned between the two barrel parts for axially displacing the parts relative to one another, when the gun is pressed against the receiving material, the front part of the barrel is moved rearwardly into the gun housing. The spring positioned between the two barrel parts is compressed, however, the latch secures the rear barrel part from movement toward the breech block. Subsequently, by disengaging the latch, the rear barrel part is released and under the biasing action of the spring is driven in an accelerated manner toward the breech block for firing the propellent charge.

In another embodiment, a compressible spring is positioned between the housing and the barrel for driving the barrel toward the breech block.

In such an arrangement, the barrel is placed in the ready position by pushing it forwardly in the housing against the force of the compressible spring. The barrel is latched in the ready position and, when the latch is released, the spring drives the barrel rearwardly against the breech block for firing the propellent charge, as described above. In this arrangement, there is the advantage that the barrel does not project outwardly from the front end of the housing and it is possible to very accurately position the setting gun at the points at which a fastening element is to be inserted. Therefore, this embodiment is particularly suitable for accurately locating and inserting fastening elements.

In another embodiment of the invention, the barrel is held in the ready position by a stop member when the barrel is displaced relative to the housing against the spring. The stop member is supported on the housing and extends into the path of the barrel. The stop member is supported so that it can be displaced from engagement with the barrel. It is preferable if the stop member is constructed in the form of a trigger mounted in a handle grip, such as is well known, so that it can be easily manipulated for displacement from locking engagement with the barrel.

A feature of the stop member arrangement is the manner in which it is pivotally supported in the handle grip. This arrangement makes it particularly easy to operate the stop member.

In a preferred arrangement of the stop member, a spring is mounted within the handle grip and biases the stop member into engagement with the barrel. The stop member is positioned so that it automatically engages the rear of the barrel and can be easily manually operated to effect the disengagement of the stop member for releasing the barrel.

To improve the safety of the setting gun, it is advantageous to guide a driving piston within the barrel which is driven by the gases generated when the propellent charge is fired. The driving piston transmits the energy of the explosive gases generated by the propellent charge to the fastening element. Such a driving piston ensures a low exit velocity of the fastening element from the barrel, as well as the possibility of reduced excess energy in the gun itself.

Another feature of the invention involves the use of the breech block to support a magazine in which the propellent charges are held in spaced relation. A guide groove is provided in the breech block to receive the magazine and hold it and the housing is also provided with a passageway for introducing the magazine into the guide in the breech block.

Such an arrangement provides considerable time savings in loading the magazine. Moreover, when caseless propellent charges are used in the magazine the above arrangement greatly facilitates the handling of the magazine. If the firing action is provided by a firing projection formed on the rear end of the barrel, the magazine can completely seal off the propellent charge on the side facing the breech block, so that fouling of the breech block is avoided.

In a preferred arrangement, the magazine has torus-shaped projections which surround and hold the propellent charges and such projections cooperate with an annular shoulder on the rear end of the barrel in providing an extremely tight firing chamber for the gun. This construction of the magazine prevents the propellent charges from falling out or being damaged when the magazine is transported. Since the magazine is changed each time the gun is loaded, no combustion residues can accumulate. Problems usually caused by explosive powder residues can be avoided. For guns used in effecting a series of fastenings, it is preferable to use a band-shaped magazine. Such a magazine required little space in the gun. The number of propellent charges arranged in the magazine can be freely selected. Furthermore, parts of the magazine from which the propellent charge have been fired can be constantly removed so that they do not interfere with the handling of the gun.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

DETAIL DESCRIPTION OF THE INVENTION

Figure 1:
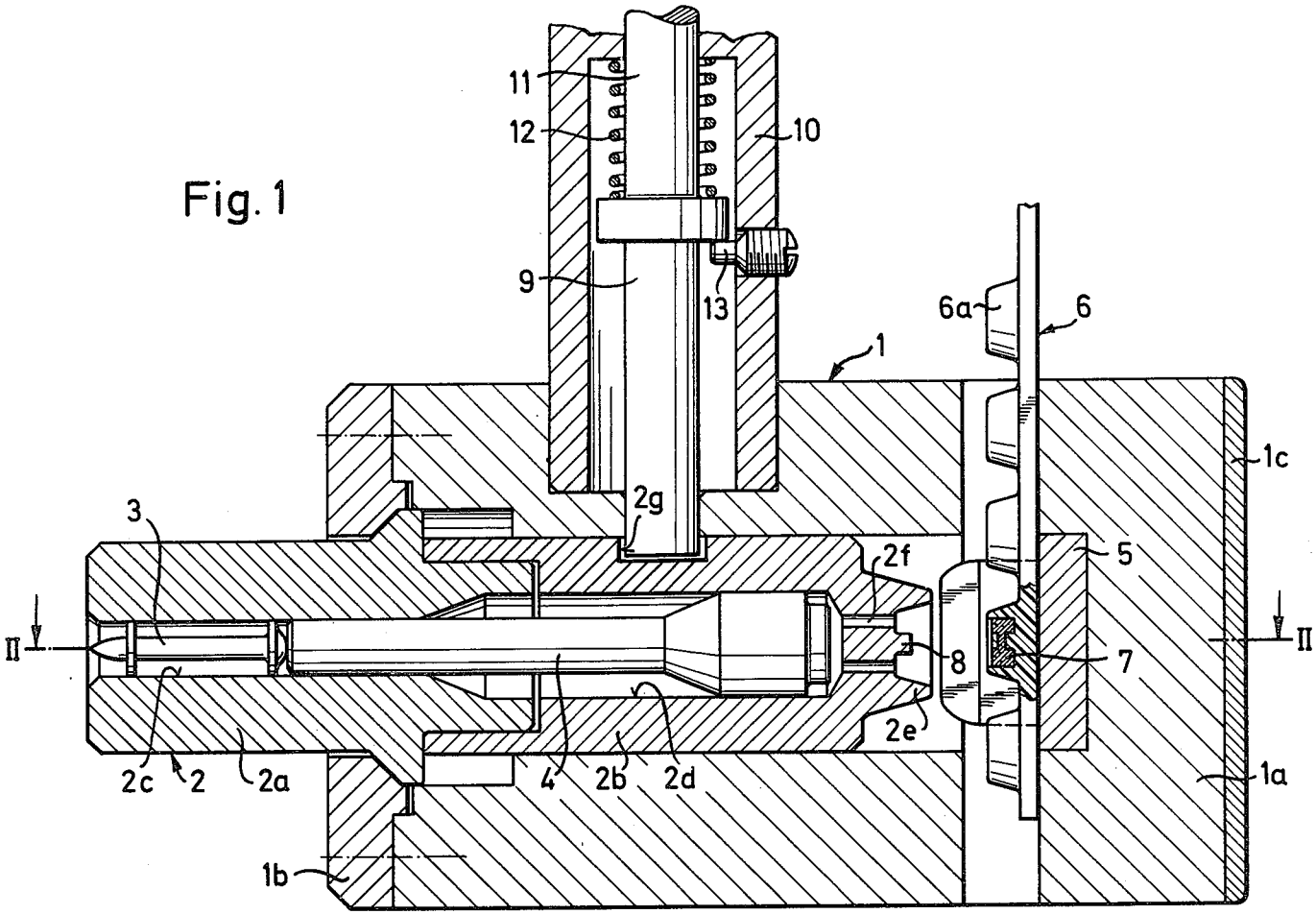
FIG. 1 is a vertical sectional view of a setting gun embodying the present invention taken along the line I—I in FIG. 2 and with the gun shown in position ready to be fired.
Figure 2:
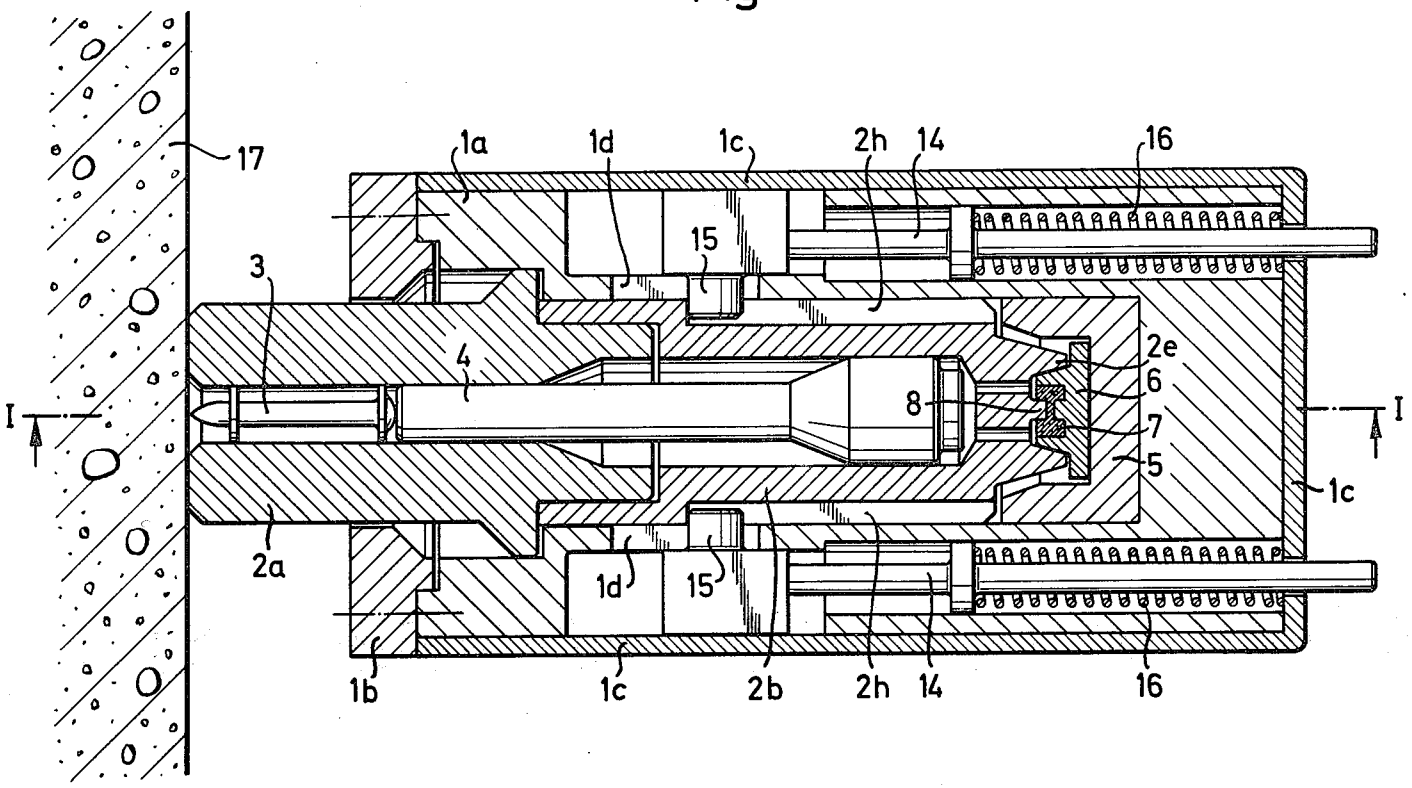
FIG. 2 is an axially extending sectional view taken along line II—II in FIG. 1, however, with the gun shown in the firing position.

In FIGS. 1 and 2 an explosive charge driven setting gun is displayed and includes a housing 1, a barrel 2 axially displaceably mounted within the housing with its front end extending outwardly from the housing. As viewed in FIGS. 1 through 5 the firing direction of the setting guns shown is toward the left hand side of each figure. In the description the front end of the various parts refers to the end facing opposite to the firing direction, that is, toward the right hand side of the figures.

Housing 1 consists of a block 1*a* having a bore extending in the firing direction with a portion of the block acting as a closure across the rear end of the bore. A front cover plate 1*b* is secured to the block at its front end and a covering 1*c* surrounds the block on three sides, note FIG. 2. The barrel 2 consists of two parts, a front part 2*a* with its front end projecting outwardly from the housing and a rear barrel part 2*b* located within the bore in the housing. The front cover plate 1*b* provides a shoulder facing rearwardly which acts as a stop for the movement of the front barrel part 2*a* in the firing direction.

The front barrel part 2*a* has an axially extending bore which forms a fastening element guide 2*c* for a fastening element 3 located in the forward end of the guide 2*c*. The rear barrel part 2*b* has a bore in axial alignment with the bore in the front barrel part and the bore in the rear barrel part forms, in combination with the fastening element guide 2*c*, a piston guide 2*d* in which a driving piston 4 is mounted In sliding contact, that is, the larger rear end or head of the piston slides in contact with the guide 2*d* while its forward smaller diameter shank portion rides in sliding contact with the guide 2*c* and is arranged to contact and drive the fastening element 3 from the front end of the barrel. A breech block 5 is located in the part of the block 1*a* which extends transversely across the rear end of the bore through the housing. A magazine 6 extends to the rear end of the bore through the housing. A magazine 6 extends to the rear part of the housing in contact with the breech block 5 and its supports, in spaced relation, a plurality of careless propellent charges 7.

Magazine 6 is an elongated band shaped member and, as can be seen in FIGS. 1 and 2, it has a number of torus-shaped projections 6*A* facing in the firing direction which laterally surround and closely contact the propellent charges 7. At its rear end, the barrel 2 is provided with a firing mose or projection 8 which extends from the rear end of the barrel so that it contacts and fires or ignites the propellent charges 7. Laterally encircling the firing projection 8 on the rear end of the barrel is an annular shoulder 2*e* which, together with the magazine 6, forms a firing chamber when the rear barrel part 2 is located in the position shown in FIG. 2. When a propellent charge 7 is fired, the explosive gases generated by the charge flow through channels 2*f* into the working space defined between the rear end of the guide 2*d* and the rear end of the piston 4. A disengageable latch 9 is mounted on the housing and extends into a groove 2*g* formed in the rear part 2*b* of the barrel 2. With the latch 9 engaged in the groove 2*g*, it prevents any axial movement of the barrel so that the rear part 2*d* cannot be displaced into contact with the propellent charge.

In FIG. 1 it can be seen that the setting gun is secured on an actuating pipe 10 and an extension rod 11 extending transversely of the firing direction is connected to the latch 9 so that remote control of the latch can be provided. A spring 12 laterally encircles the rod 11 between a shoulder formed by the actuating pipe 10 and the member connecting the rod and the latch together. The spring biases the connecting member toward a stop 13 extending through the pipe 10 on the housing side of the connecting member. As a result, the spring 12 biases the connecting member into contact with the stop and at the same time biases the latch 9 into the groove 2*g* holding the rear barrel part 2*b* in the locked position with its rear end spaced forwardly from the propellent charge 7 supported against the breech block 5. Before the setting gun can be fired, the latch 9 must be disengaged by means of the extension rod 11. With the front end of barrel part 2*a* pressed against the receiving material the release of the latch causes the barrel to be displaced rearwardly, opposite to the firing direction, in an abrupt manner with its firing projection 8 striking the propellent charge 7 and causing it to be fired. The explosive gases generated by the ignition of the propellent charge, flow through the channels 2*f* and propel the piston 4 against the fastening element 3 driving it into the receiving material 17, note FIG. 2.

In the firing positon illustrated in FIG. 2, the barrel 2 is in its rearward position relative to the housing 1. The annular shoulder 2*e* at the rearward end of the barrel, in combination with the magazine 6, seals the firing chamber. Further, two axially elongated pins, extending in the firing direction, are mounted within the block 1*a* and each have a cam 15 on its forward end which extends through a slot 1*d* in the block into tthe longitudinally extending grooves 2*h* in the rear part 2*b* of the barrel 2. When the front end of the barrel is pressed against the receiving material 17, the pins are pushed rearwardly by the shoulder provided by the front end of the grooves 2*h* causing the pins to project rearwardly through the rear end of the block 1*a* and the covering 1*c*. When the gun is removed from the receiving material, the pins 14 are returned in the firing direction by springs 16. The springs 16 encircle the pins 14 and extend between a stop member formed on the pin and the covering 1*c* at the rear end of the housing. The movement of the pins 14 due to the engagement of their cams 15 with the barrel 2, returns the barrel to its starting position, shown in FIG. 1.

If the rear end of the setting gun strikes against the receiving material 17 or another surface, the pins 14 tend to emerge from the housing but are prevented from doing so and, in turn, prevent the barrel from moving rearwardly against the propellent charge 7.

Figure 3:
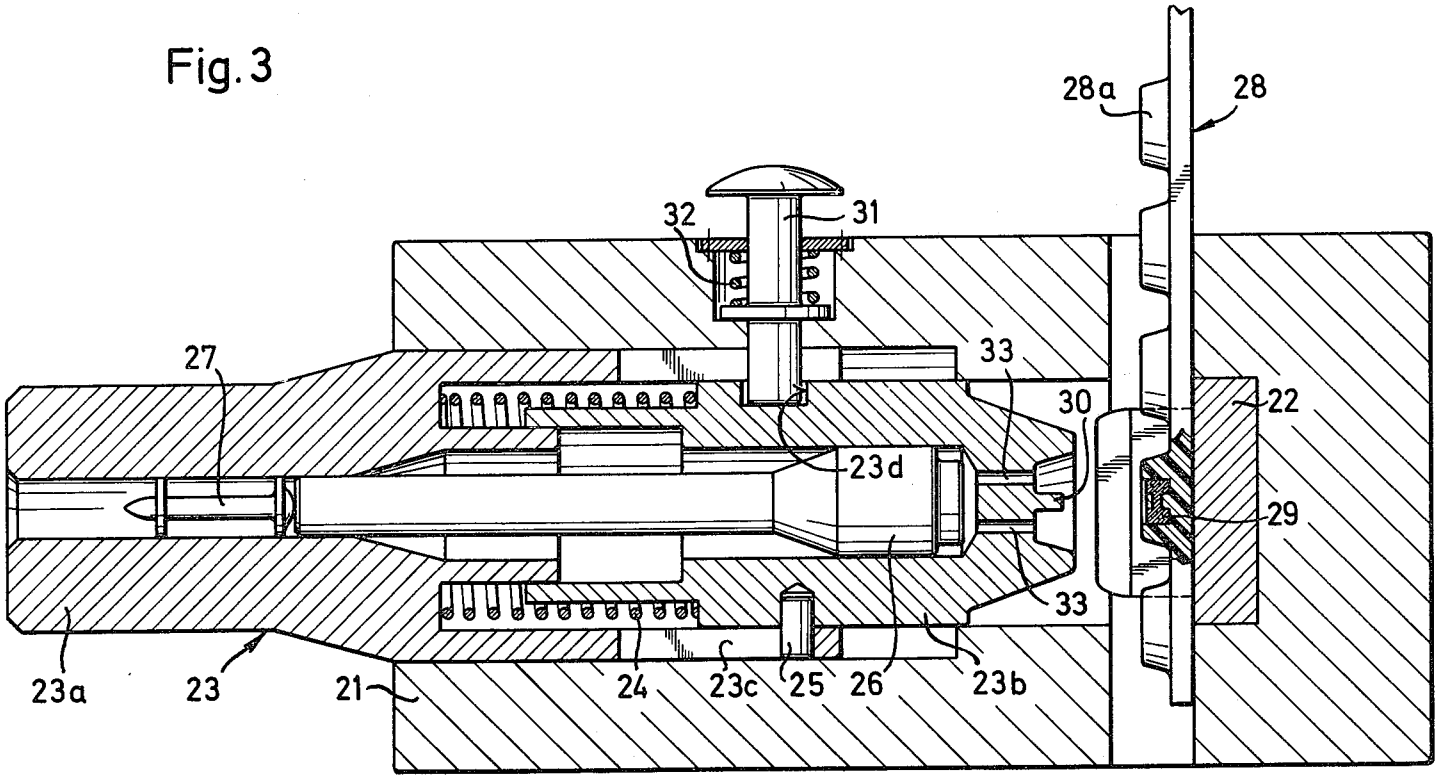
FIG. 3 is an axially extending sectional view of a setting gun incorporating another embodiment of the present invention in which the barrel consists of two mutually displaceable parts.

Another embodiment of the present invention is shown in FIG. 3 with the setting gun including a housing 21 forming an axially extending bore with a breech block 22 seated in the housing at the rear end of the housing bore. A barrel 23 is positioned within the housing bore and consists of two parts, a front barrel part 23*a* and a rear barrel part 23*b* with the two barrel parts fitting one into the other. Front barrel part 23*a* and rear barrel part 23*b* are axially displaceable relative to one another to a limited extent against the force of a spring 24 which extends between the two parts, when the two parts move one into the other the spring is compressed. The relative axial displaceability of the two barrel parts is limited by a slot 23*c* extending in the firing direction and a pin 25 secured to the rear barrel part 23*b* and extending outwardly into the slot 23*c* which is formed in the front barrel part. An axially extending bore is provided through the two barrel parts and supports a driving piston 26 in slidable contact. As shown in FIG. 3, a fastening element 27 is located within the part of the barrel bore within the front barrel part 23*a*. In the rear portion of the housing 21 a magazine 28 extends transversely of the housing bore and supports a plurality of spaced caseless propellent charges 29. As in FIGS. 1 and 2, a torus-shaped projection 28*a* laterally encloses each of the propellent charges. At its rear end, the rear barrel part 23*b* has a rearwardly extending firing projection 30. Further, a disengageable latch 31 is mounted in the housing 21 and extends into a groove 23*d* located in the rear barrel part 23*b*. A spring 32 encircles the latch 31 and bears against the housing at one end and against the latch at its other end for biasing the latch into engagement with the groove 23*d*.

When the gun shown in FIG. 3 is pressed against a receiving material, the front barrel part 23*a* is displaced rearwardly relative to the rear barrel part which is held in a locked position by the latch 31. As a result, the spring 24 is compressed between the two barrel parts. With the front barrel part pressed against the receiving material, when the latch 31 is disengaged from the groove 23*d*, the rear barrel part 23*b* is accelerated in the rearward direction, opposite to the firing direction, against the breech block 22 by the compressed force of the spring. When the projecting 30 at the rear of the barrel contacts the propellent charge 29 it fires it and the explosive gases generated by the ignited charge flow from the firing chamber through channels 33 in the rear barrel part into the working space provided by the combination of the rear barrel part and the piston 26.

Figure 4:
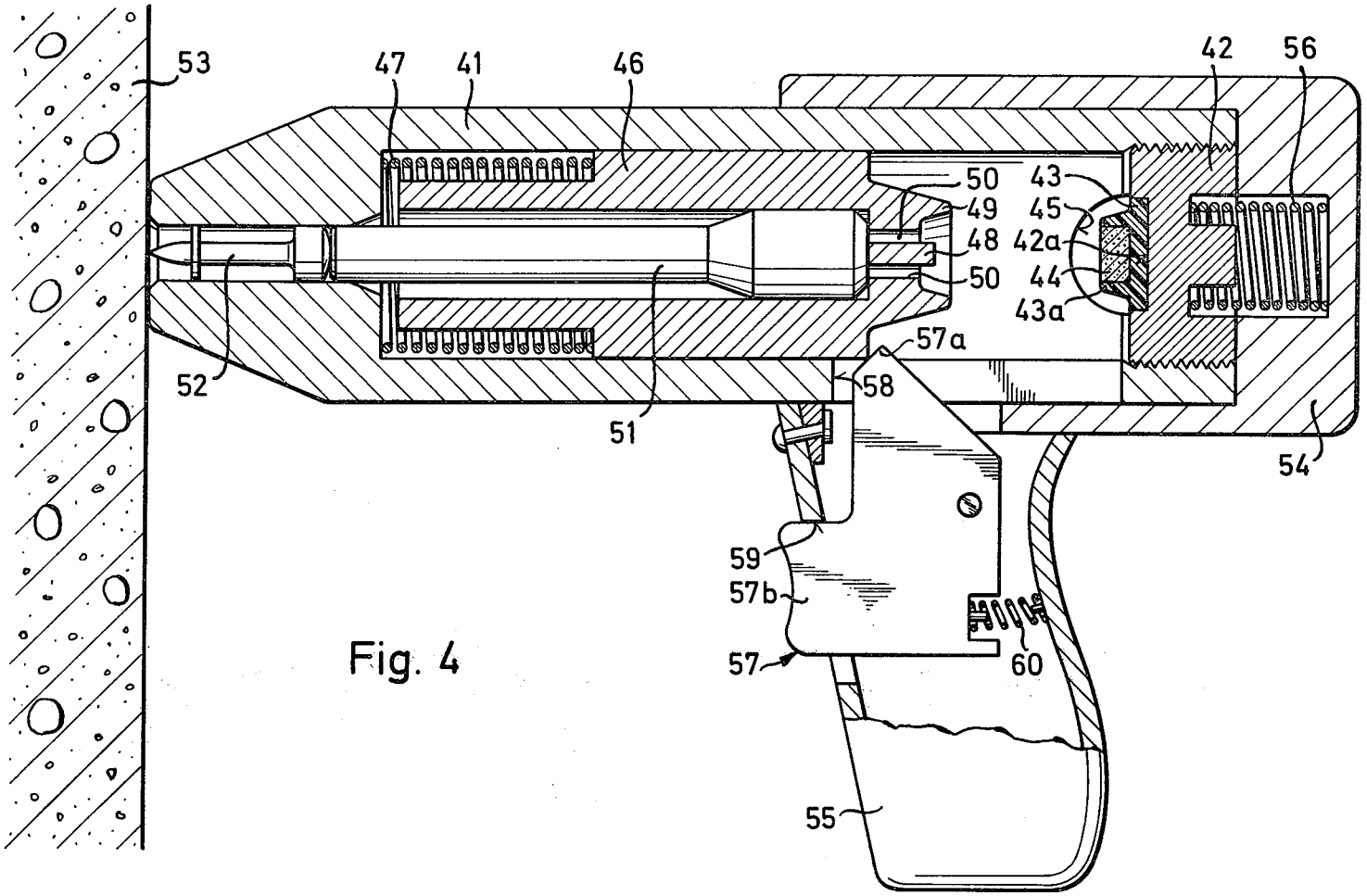
FIG. 4 is an axially extending sectional view of a setting gun incorporating still another embodiment of the present invention and with the gun illustrated in position ready to be fired.
Figure 5:
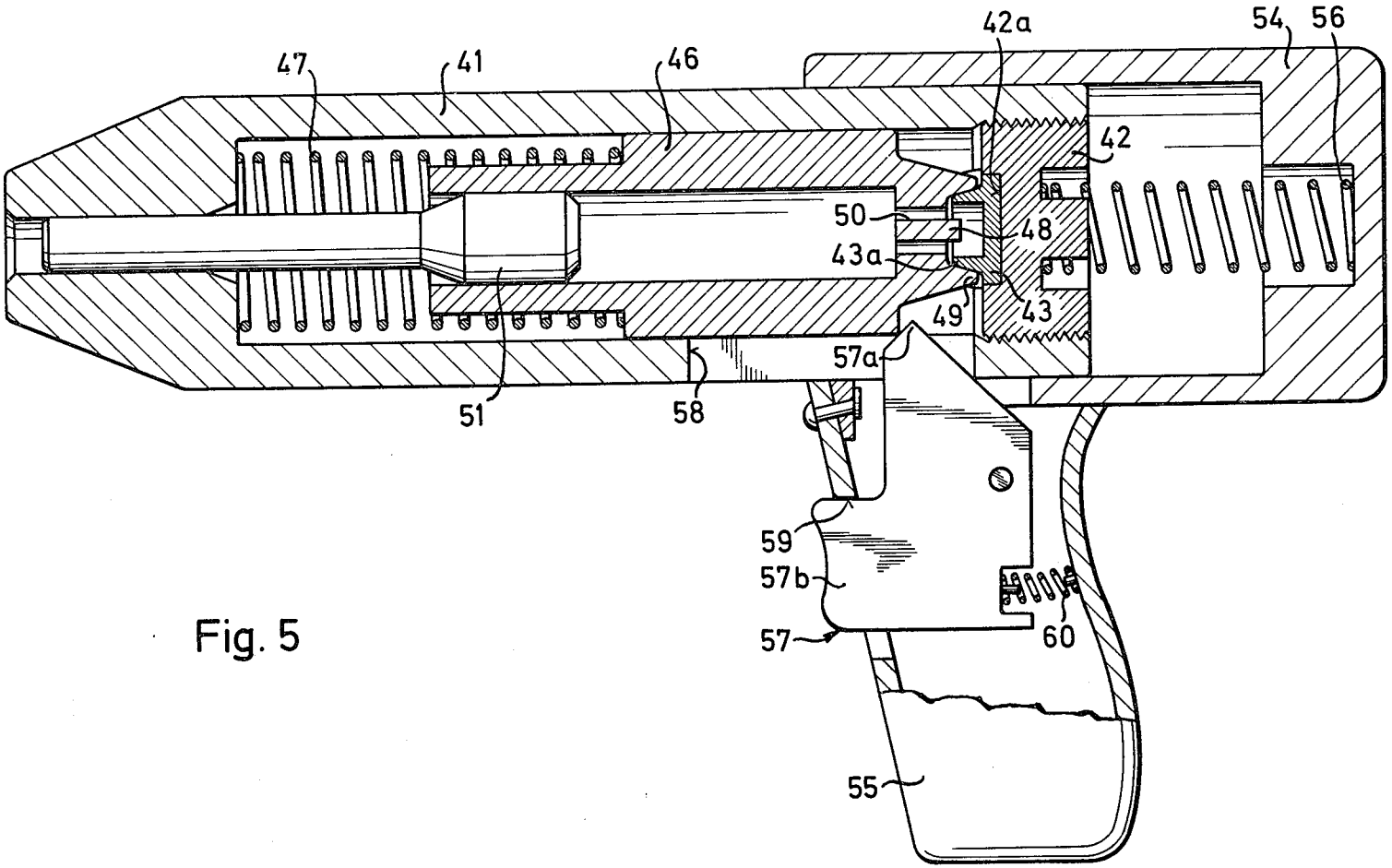
FIG. 5 is an axially extending sectional view of the gun shown in FIG. 4 with the parts of the gun located in position after the firing has been completed and the gun removed from the receiving material shown in FIG. 4.

In FIGS. 4 and 5 another setting gun is shown embodying the present invention which has a housing 41 supporting a breech block 42 at its rear end. As with the other embodiments, the breech block serves as an abutment for the propellent charge 44 located in a band-shaped magazine 43 and laterally enclosed by a torus-shaped projection 43*a*. The breech block 42 has a guide groove 42*a* which serves as a guide for the magazine 43 as the serially arranged propellent charges in the magazine are moved into alignment behind the barrel of the setting gun. Further, a passage 45 is formed in the housing for inserting the magazine 43 into the guide groove 42*a*. Unlike the other two embodiments, in FIGS. 4 and 5 a barrel 46 is provided which is completely enclosed within the housing 41, the barrel does not project from the front end of the housing. A spring 47 laterally encircles the front end of the barrel 46 and extends forwardly into contact with the housing 41. At its rear end, the barrel has a firing nose or projection 48 which is laterally encircled by a frustoconically shaped shoulder 49 which has an inner surface complementary to the torus-shaped projection 43*a* on the magazine so that the shoulder fits over the torus-shaped projection. Further, the rear end of the barrel has channels 50 which convey the explosive gases from the firing chamber defined by the shoulder 49 and the magazine 43 into the bore within the barrel for driving a piston 51 which is axially displaceable through the barrel into the bore in the housing located forwardly of the barrel. As shown in FIG. 4, a fastening element 52 is located in the bore in the housing and when the propellent charge is fired the piston propels the fastening element into the receiving material 53.

For a part of the rear portion of the housing 41, a cap-shaped member 54 encircles the housing and a handle grip 55 is attached to the cap-shaped member and extends transversely of the firing direction outwardly from the member. The cap-shaped member has a recess aligned behind both the breech block and the axially extending bore through the barrel, and it contains a spring 56. The spring 56 biases the cap-shaped member rearwardly from the breech block, the spring extends between an annular recess in the breech block and the recess in the cap-shaped member. In the handle grip 55 a follower or stop member 57 is pivotally mounted and is constructed as a trigger. A portion or nose 57*a* of the stop member 57 projects through an opening 58 in the housing 41 into the path of the barrel 46 within the housing. Clockwise rotation of the stop member 57 is limited by contact with an edge 59 formed in the handle grip, that is, the upper edge of a trigger or control button 57*b* contacts the edge 59 and prevents further clockwise movement of the stop member. Within the handle grip, a spring 60 is biased against the lower rearward edge of the stop member and presses it in the clockwise direction around its pivotal axis.

The position of the gun shown in FIG. 4 with the barrel 46 in the ready to be fired condition is reached by pressing the front end of the housing 41 against the receiving material 53. The barrel is held in the forward position by the nose 57*a* of the stop member 57 while the housing has moved rearwardly over the barrel causing the spring 47 to be compressed. Similarly, since the pressing action is achieved by the handle grip 55 the housing slides rearwardly into the member 54 also compressing the spring 56.

With the gun in the position shown in FIG. 4 the trigger button 57*b* can be pressed inwardly into the handle grip with the spring causing clockwise rotation about the pivotal axis so that nose 57*a* releases the barrel 46. Since the stop member 57 no longer exerts a force opposite to the spring 47, the spring is released and accelerates the barrel and its piston 51 against the breech block 42 with the firing projection 48 striking against the propellent charge 44 and causing it to be ignited. The explosive gases generated flow from the firing chamber enclosed by the annular shoulder 49 and the torus-shaped projection 43*a* into channels 50 entering the rearward end of the barrel bore and propelling the driving piston 51 against the fastening element 52 and forcing the element into the receiving material 53.

After the fastening element has been inserted, the setting gun is removed from the receiving material 53 and it again assumes the position shown in FIG. 5. The barrel 46 is pressed rearwardly by the spriing 47 and the driving piston is in the forward position it has reached during the driving process. Spring 56 presses the member 54 and its associated handle grip 55 to the rear relative to the housing. At the same time, the stop member 57 with its nose 57*a* sliding on a barrel surface likewise is moved rearwardly and in the rearward position the nose again moves into contact with the rear end of the barrel with this movement being effected automatically by the spring 60 within the handle grip.

Before the next fastening element is inserted, the driving piston 51 is pushed in a conventional manner to the rear of the barrel bore and a new fastening element is inserted into the bore located in the front end of the housing. When the front end of the housing 41 is again pressed against the receiving material 53 the various parts of the gun assume the position as shown in FIG. 4. The next propellent charge 44 within the magazine 43 is moved into the firing position by a known feed mechanism, not shown, while the setting gun is pressed against the receiving material.

While specific embodiments of the invention have been shown and described in detail to illustrate the application of the inventive principles, it will be understood that the invention may be embodied otherwise without departing from such principles.

What is claimed is:

1. An explosive charge driven setting gun for firing an explosive charge and using force generated by the explosive charge for driving fastening elements and the like into a receiving material, comprising a housing having a bore extending in the firing direction of the gun, said bore having a rear end and a front end spaced in the firing direction from said rear end, a barrel axially displaceably mounted within the bore in said housing, said barrel having a forward end facing in the firing direction and a rearward end facing in the opposite direction, a breech block positioned in said housing at the rear end of said bore and in alignment with said barrel, said breech block arranged to support a propellent charge, wherein the improvement comprises means formed on the rearward end of said barrel for firing the propellent charge supported on said breech block when said barrel is displaced rearwardly against said breech block.

2. An explosive charge driven setting gun, as set forth in claim 1, wherein said means for firing the propellent charge comprises a projection on the rearward end of said barrel extending therefrom toward said breech block.

3. An explosive charge driven setting gun, as set forth in claim 2, wherein an annular shoulder is formed on the rearwardly end of said barrel laterally encircling said projection for forming a portion of a firing chamber for the propellent charge supported on said breech block.

4. An explosive charge driven setting gun, as set forth in claim 1, wherein at least one pin extending in the firing direction is axially displaceably mounted within said housing, said pin is in operative engagement with said barrel for displacement with said barrel opposite to the firing direction and when said barrel is displaced rearwardly against said breech block said pin projects rearwardly from the rear end of said housing.

5. An explosive charge driven setting gun, as set forth in claim 1, wherein a latch is displaceably mounted in said housing and extends into locking contact with said barrel for holding the rearward end of said barrel in spaced relation to said breech block so that said barrel can be displaced rearwardly against said breech block only after said latch is displaced from locking contact with said barrel.

6. An explosive charge driven setting gun, as set forth in claim 1, wherein spring means are mounted in said housing and disposed in contact with said barrel for biasing said barrel away from said breech block.

7. An explosive charge driven setting gun, as set forth in claim 6, wherein said spring means comprises at least one pin extending in the firing direction and axially displaceably mountd in said housing, said pin having a lateral projection thereon extending into contact with said barrel for blocking the displacement of said barrel rearwardly against said breech block, a spring encircling said pin and contacting said pin at one end and contacting said housing at its other end at a location rearwardly from the contact with pin, said housing having an opening in its rearward end aligned with said pin so that said pin can pass rearwardly through the opening in said housing permitting said barrel to move rearwardly against said breech block.

8. An explosive charge driven setting gun, as set forth in claim 1, wherein said barrel comprises two axially extending parts consisting of a front barrel part and a rear barrel part with said rear barrel part located closer to said breech block than said front barrel part.

9. An explosive charge driven setting gun, as set forth in claim 8, wherein said front and rear barrel parts being axially displaceable relative to one another.

10. An explosive charge driven setting gun, as set forth in claim 9, wherein a latch is displaceably mounted in said housing and extends into locking contact with said rear barrel part for holding the rearward barrel part in spaced relation to said breech block.

11. An explosive charge driven setting gun, as set forth in claim 10, wherein a compressible spring is positioned in contact with an extending between said front barrel part and said rear barrel part so that in the compressed state said spring can displace said rear barrel part rearwardly against said breech block.

12. An explosive charge driven setting gun, as set forth in claim 11, wherein said front and rear barrel parts are arranged to move one into the other so that said front barrel part is displaceable opposite to the firing direction relative to said rear barrel part against said spring for compressing said spring when said rear barrel part is locked by said latch whereby upon subsequent displacement of said latch from locking engagement with said rear barrel part, said rear barrel part is biased in the direction of said breech by the compressed said spring.

13. An explosive charge driven setting gun, as set forth in claim 11, wherein a first compressible spring is positioned within said housing in contact with and extending between said housing and said barrel so that said barrel can be biased by said spring toward said breech block.

14. An explosive charge driven setting gun, as set forth in claim 13, wherein a displaceable stop member is mounted on said housing and is arranged to contact said barrel and prevent said barrel from moving against said breech block, said stop member displaceable between a first position where it contacts said barrel preventing said barrel from moving rearwardly and a second position where said stop is positioned from contact with said barrel.

15. An explosive charge driven setting gun, as set forth in claim 14, wherein said stop member is pivotally supported in said housing and is angularly displaceable about the pivotal support between the first and second positions.

16. An explosive chage driven setting gun, as set forth in claim 15, wherein a second spring is positioned within said housing and in contact with said stop member for biasing said stop member about the pivotal support, and said housing forming a shoulder against which said second spring biases said stop member for securing said stop member in position for blocking the rearward movement of said barrel.

17. An explosive charge driven setting gun, as set forth in claim 16, wherein said housing includes a cap member slidably displaceably positioned on the rearward end of said housing, and a third spring extending between said cap member and said breech block and biasing and cap member rearwardly from said breech block.

18. An explosive charge driven setting gun, as set forth in claim 17, wherein said housing includes a handle grip attached to said cap member, said stop member pivotally mounted in said handle grip for movement into the path of said barrel within said housing, and said second spring positioned within said handle grip.

19. An explosive charge driven setting gun, as set forth in claim 1, wherein said barrel forms a second bore having the axis thereof extending in the firing direction, a driving piston disposed in sliding contact with the surface of said second bore and arranged to be driven through the second bore for driving fastening elements from the setting gun into a receiving material.

20. An explosive charge driven setting gun, as set forth in claim 3, wherein a magazine supports propellent charges therein in spaced relation to one another, said breech block forming a guide way for receiving said magazine and positioning individual propellent charges in alignment with said means on the rear end of said barrel.

21. An explosive charge driven setting gun, as set forth in claim 20, wherein torus-shaped projections are formed on said magazine for laterally enclosing the propellent charges, said torus-shaped projections shaped to fit in closely fitting contact within said annular shoulder formed on the rearward end of said barrel.

22. An explosive charge driven setting gun, as set forth in claim 21, wherein said magazine is an elongated band-shaped member with said torus-shaped projections spaced apart in the elongated direction of said band-shaped member.

23. An explosive charge driven setting gun, as set forth in claim 5, wherein said latch extends transversely of the firing directions in contact with said barrel, and spring means in contact with said latch for biasing said latch into contact with said barrel.

24. An explosive charge driven setting gun, as set forth in claim 1, wherein said housing comprises a block extending in the firing direction and forming a closure for the rear end of the bore in said housing, a front cover plate secured to the front end of said block facing in the firng directions, said breech block bearing against the portion of said block forming the closure for the rear end of the housing bore, said barrel comprises two axially extending parts located within said block and consisting of a front barrel part and a rear barrel part located closer to said breech block than said front barrel part, and said front cover plate forming a shoulder providing a stop for preventing said front barrel part from moving out of said block.

* * * * *